US007421801B2

(12) United States Patent
Kluetsch et al.

(10) Patent No.: US 7,421,801 B2
(45) Date of Patent: Sep. 9, 2008

(54) METHOD AND APPARATUS FREEZE-DRYING CHAMBER LOADING AND UNLOADING DEVICES USING CHARGING PLATES, CONVEYORS, SLIDERS

(75) Inventors: Hubert Kluetsch, Cologne (DE); Johannes Selch, Woerth (DE); Joerg Rosenbaum, Nettersheim (DE)

(73) Assignee: Gea Lyophill GmbH, Huerth (DE)

( * ) Notice: Subject to any disclaimer, the term of this patent is extended or adjusted under 35 U.S.C. 154(b) by 90 days.

(21) Appl. No.: 11/402,342

(22) Filed: Apr. 12, 2006

(65) Prior Publication Data

US 2006/0254076 A1 Nov. 16, 2006

(30) Foreign Application Priority Data

Apr. 13, 2005 (DE) ..... 10 2005 017 140

(51) Int. Cl.
*F26B 5/06* (2006.01)

(52) U.S. Cl. ..... 34/284; 34/92; 34/236; 414/18; 414/215; 198/600

(58) Field of Classification Search ..... 34/284, 34/92, 236; 414/18, 215; 198/600
See application file for complete search history.

(56) References Cited

U.S. PATENT DOCUMENTS

| | | | | |
|---|---|---|---|---|
| 2,089,068 | A | 8/1937 | Newell et al. | 214/26 |
| 5,129,162 | A | 7/1992 | Hemmersbach et al. | 34/5 |
| 5,649,800 | A | 7/1997 | Hemmersbach et al. | 414/180 |

FOREIGN PATENT DOCUMENTS

| | | |
|---|---|---|
| DE | 42 15 781 | 11/1993 |
| DE | 19823167 | 12/1999 |
| DE | 20102879 U | 10/2001 |
| DE | 10307571 | 9/2004 |
| EP | 391 208 | 10/1990 |
| WO | WO 93/23319 | 11/1993 |
| WO | WO 2004/074143 A1 | 9/2004 |

*Primary Examiner*—S. Gravini
(74) *Attorney, Agent, or Firm*—Fay Sharpe LLP

(57) ABSTRACT

A freeze-drying apparatus has a chamber (3) in which are located superposed charging plates (4) as well as loading and unloading equipment. The chamber has a loading aperture (2) equipped with closing doors (11, 12) through which the charging plates (4) are loaded. Equipment for loading the charging plates (4) with containers (5) is positioned in front of the loading aperture (2) and comprises a conveyor belt (6) which serves to supply the containers (5) and a transfer table (7) which is movable between an operating position and an idle position. The transfer table bridges a gap between conveyor belt (6) and the charging plate (4). A loading slider (8) provides push-wise transfer of a plurality of the containers (5) from the conveyor belt (6) via the transfer table (7) onto the charging plate (4). For a reduction of loading times, the transfer table (7) retains substantially in its operating position during the loading of the charging plates (4) and at least the region of the loading aperture (2) above the transfer table (7) is closed following each loading push.

22 Claims, 5 Drawing Sheets

METHOD AND APPARATUS FREEZE-DRYING CHAMBER LOADING AND UNLOADING DEVICES USING CHARGING PLATES, CONVEYORS, SLIDERS

BACKGROUND

The invention concerns a method for the operation of freeze-drying equipment with a chamber and with loading and unloading devices, including equipment appropriately designed for such purpose having the characteristics of the superimposed concepts of the independent patent claims.

In modern freeze-drying equipment, as known from U.S. Pat. No. 5,129,162, U.S. Pat. No. 5,649,800 and DE 103 07 571 A1, there exists the necessity of charging a multitude of charging areas, which are arranged on top of each other in a chamber with a multitude of containers, small bottles and similar items and to remove same again from the charging areas after completion of the freeze-drying process.

The containers come from a filling device via a conveyor belt to the freeze-drying chamber. Customarily, the filling device essentially operates on a continuous basis; whereas, the loading of the charging areas takes places intermittently. It is therefore necessary to provide a buffer zone for the containers between the filling device and the chamber. It consists, for example, of a multitude of conveyor belt loops adapted to the buffer demand.

Loading of the chamber or of the charging areas takes place with the aid of a transfer table and a slider system, namely through a lockable loading aperture which is part of a wall or a door of the freeze-drying chamber. In its operating position, the transfer table connects the planes of conveyor belt and charging area to be loaded.

In the feed and loading phases, the containers are still open. Traditionally, a cork, which has a cut-out for the evacuation of the water vapor during freeze-drying, is positioned on the opening of the containers. After completion of the freeze-drying process, the closing of the corks takes place in the still locked chamber by driving the charging areas together. After opening of the loading aperture follows the unloading of the charging areas, which likewise takes place with the aid of the transfer table and the slider system. With the aid of the already mentioned or via an additional conveyor belt, the containers are brought to a device where they are fitted with caps.

Freeze-drying predominantly serves for conservation of pharmaceutical products so requirements in regard to sterility are very high. Freeze-drying installations therefore are located in clean-rooms or they are equipped with so-called isolators. The isolator room, which is preferably constituted by transparent wall sections, encloses those areas of the freeze-drying equipment in which clean-room conditions must be maintained. This includes mainly the means, in particular conveyor belts, which serve for taking the still open containers from the filling device up to the chamber and the area before the chamber in which the loading and unloading means are arranged. Generally, the transport means between the freeze-drying chamber and the device for final sealing of the containers with caps are also arranged in the isolator.

With increasing number of containers of product to be freeze-dried, the loading times become longer and longer. Frequently it is no longer possible to load the up to 2 square meter or larger charging areas in one single push. A multitude of partial pushes is needed. Each partial push requires a "to and fro" movement of the loading slider. Loading time and charging plate changing time becomes significant longer as a result. In addition, the need arises to enlarge the buffer zone.

The products to be freeze-dried are, as a rule, more or less temperature-sensitive. The charging areas or plates are therefore already during the loading phase adjusted to low temperatures (for example minus 20° C.). In order to avoid loss of quality in the end product, the goal is to also have at the start of the freeze-drying process a temperature as uniform as possible in the majority of containers. It is, therefore, the objective to keep the heat exchange as low as possible between the interior of the chamber and/or the interior of the isolator room. This is done, on the one hand, by selecting the smallest possible loading aperture. It extends across the width of the chamber and has a height which is only a little larger than the height of the loading means (transfer table, slider system). If the temperature sensitivity of the product is particularly high, it is, in addition, necessary to close the loading aperture between each of the loading pushes or partial pushes.

This requires that the transfer table which connects the planes of the conveyor belt and the charging area to be loaded, is driven in before each push and driven out after each push. Opening and closing times of the loading aperture as well as the time required for constant in and out movement of the transfer table significantly extend the loading time. The buffer zone, along with the corresponding isolator rooms, must be expanded according to the extended loading times.

SUMMARY

The present invention is based on the object of reducing the loading times of the freeze-drying chamber of a freeze-drying apparatus without endangering the products to be freeze-dried in regard to their temperature-sensitivity and without accepting any loss in quality in the final product.

Due to the fact that the transfer table retains its operating position during loading, one achieves a shortening of the loading time, inasmuch as it is no longer necessary to move the transfer table after each push or partial push from its operating position into its off-position and before each further push or partial push into the opposite direction. The time segments are shorter during which a heat exchange takes place between the interior of the chamber and the exterior space. Within the scope of the invention, the sought-after thermal de-coupling can be improved by further measures, which can be realized individually, in pairs or also jointly. One of these measures includes during the unavoidable loading pauses, i.e., between the multitude of loading pushes, closing at least part of the loading aperture. Additional measures concern the mechanical/thermal contact between the transfer table and the charging plate being loaded. Said contact is appropriately limited to the smallest possible contact areas. It is, furthermore, particularly beneficial to restrict said contact to the relatively short time intervals during which the loading pushes proper and/or the partial loading pushes proper take place. The latter can be achieved, for example, in that the transfer table is equipped in the region of its front edge with one or several liftable edge sections. The thermal contact between loadable charging area and transfer table can thus be limited to the absolutely necessary time intervals.

Still further advantages of the present invention will be appreciated to those of ordinary skill in the art upon reading and understand the following detailed description.

BRIEF DESCRIPTION OF THE DRAWING

The invention may take form in various components and arrangements of components, and in various steps and arrangements of steps. The drawings are only for purposes of illustrating the preferred embodiments and are not to be construed as limiting the invention.

DETAILED DESCRIPTION

Figure 1A:
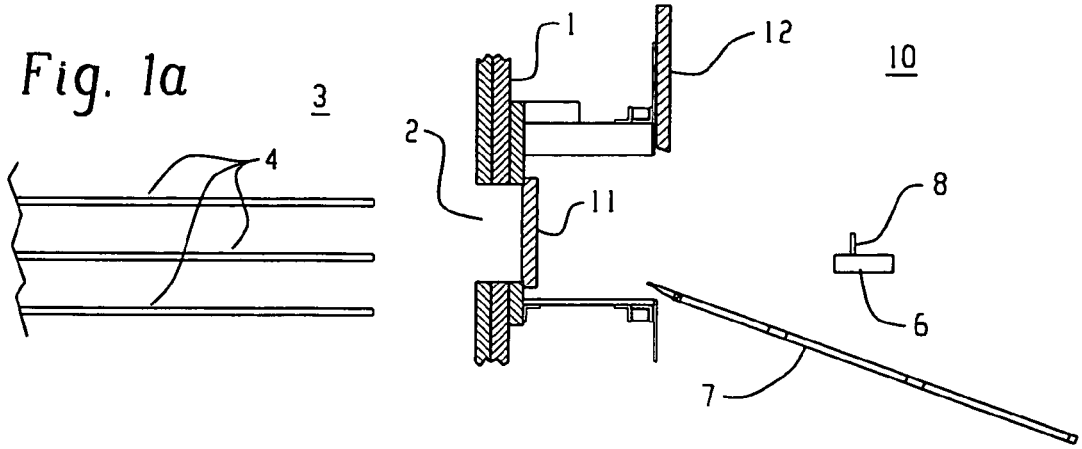
FIGS. 1*a*, 1*b*, 2*a*-2*h* and 3 depict vertical partial sections through exemplified embodiments of a freeze-drying apparatus according to the invention.

In the Figures, the wall of the freeze-drying chamber in which the loading aperture is arranged is identified with 1, the loading aperture itself with 2, the interior space of the chamber with 3, the therein located vertically displaceable charging areas or plates with 4 and examples for thereon arranged containers (vials) with 5. The charging plates can usually be heated and cooled. Not represented are cooling means connection and also the means which permit the desired vertical movement of the charging plates 4—whether for adjustment of loading height or whether for closing of containers 5.

The means for loading and unloading of charging plates 4 comprise a conveyor belt 6, a transfer table 7 and a loading slider 8. The construction components are all depicted schematically, of the loading slider 8 only the front strip. For reasons of clarity, operating devices are not represented. They may be designed in the manner as described in DE 103 07 571.2 A1.

The exterior space arranged in front of the loading aperture 2 is generally identified with 10. It is either part of the cleanroom in which the freeze-drying apparatus is located or part of an isolator.

The partially depicted freeze-drying chamber has a first door 11, with the aid of which the loading aperture can be fully and tightly closed. It is controlled in articulated fashion above the loading aperture 2 around a horizontal axis. FIG. 1*a* depicts the door 11 in its closed position, FIG. 1*b* in its open position.

Figure 1B:
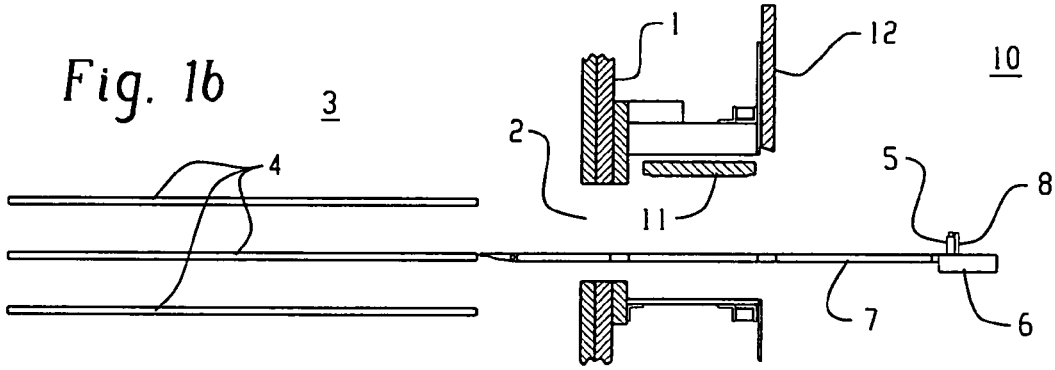

FIG. 1*a* furthermore depicts the transfer table 7 in its idle position; FIG. 1*b*, in its operating position. In its idle position, the transfer table 7 is arranged in an inclined position below the loading plane. Via means which are not shown, it is moved and tilted into its operating position (FIG. 1*b*). In said position, it joins the planes of conveyor belt 6 and one of the charging plates 4 to be loaded. The position of the loading aperture 2 is selected in such manner that the transfer table 7 in its operating position is positioned on the lower edge of the loading aperture 2.

An additional closing means is allocated to loading aperture 2. This involves a vertically displaceable sliding door 12, which is arranged above the loading aperture 2. In the context of describing the invention-specific loading process by means of FIGS. 2*a*-2*h*, the function of the sliding door 12 will be explained in more detail. In principle, the possibility exists of equipping loading aperture 2 with only one door which has the functions of both of the described doors 11, 12.

Figure 2A:
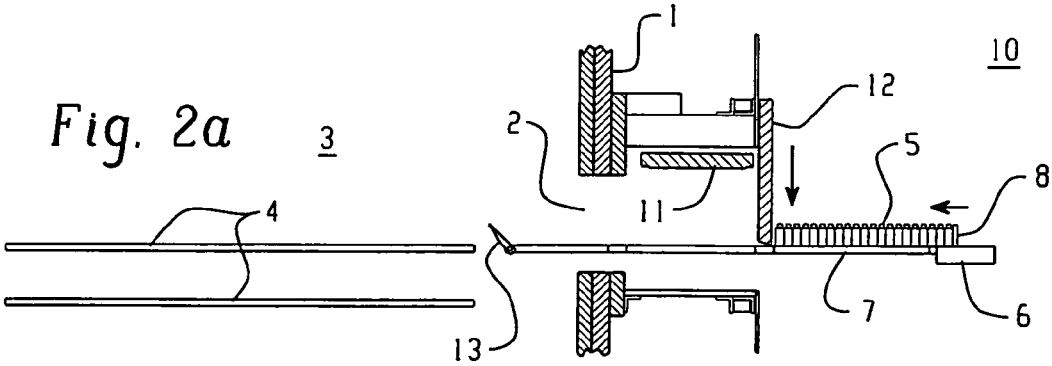

As a rule, the charging plate stack is located at the beginning of the loading process in the lower portion of the freeze-drying chamber. For loading of the uppermost charging plate 4, the uppermost plate is moved to the loading height (FIG. 2*a*). The transfer table 7 is already in its operating position. Containers 5, delivered via the conveyor belt 6 are arranged in such format on the transfer table with the aid of the loading slider or pusher 8 that they make a loading push possible. The thermal decoupling of the interior space 3 of the freeze-drying chamber from the outer space 10 is achieved, on the one hand, in that the sliding door 12 is lowered and closes, as a result, the region of the loading aperture 2 which lies above the transfer table 7. The region of the loading aperture 2 which lies below the transfer table 7 is closed in that the transfer table rests upon the lower edge of the loading aperture 2. In addition, the transfer table 7 is equipped with a liftable edge section, which will be described in more detail below. It is arranged in its raised position so that transfer of heat will not take place between the already cold charging plates 4 and the transfer table 7.

Figure 2B:
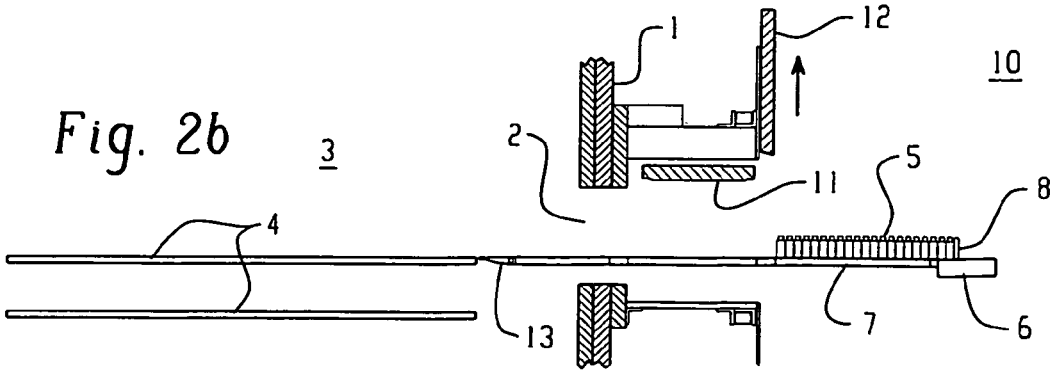
Figure 2C:
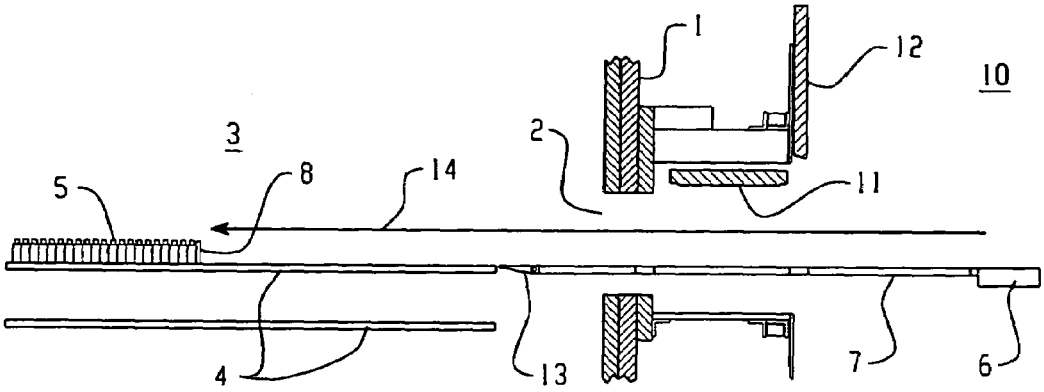
Figure 2D:
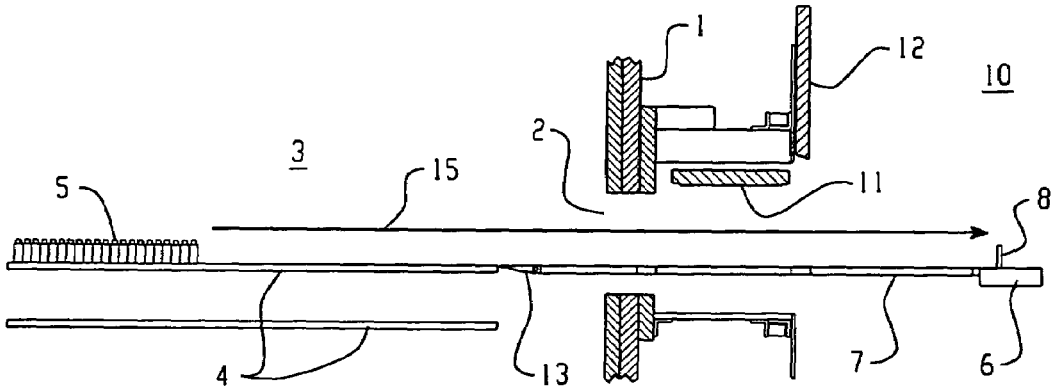
Figure 2E:
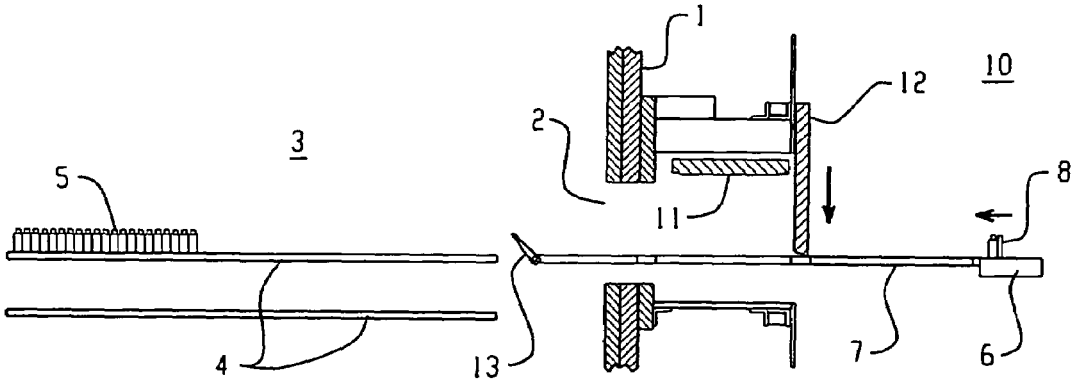

In order to prepare the first loading push, in this case a partial loading push, the sliding door 12 is opened and the edge section 13 is lowered (FIG. 2*b*). The containers 5 are pushed with the aid of the loading slider 8 onto the top charging plate 4 (FIG. 2 *c*, arrow 14). After that takes place, the retraction of the loading slider 8 (FIG. 2*d*, arrow 15), the lowering of the sliding door 12, and the raising of the edge section 13 (FIG. 2*e*).

Figure 2F:
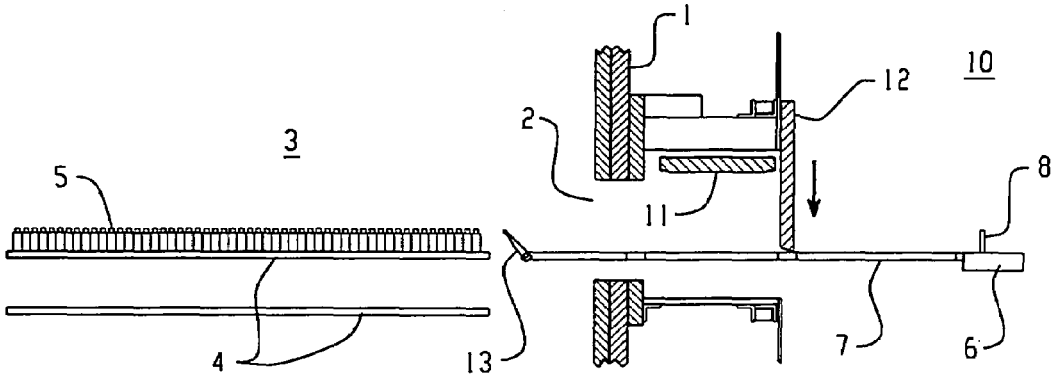

Further partial loading pushes take place in the above described fashion until the upper charging plate 4 is fully charged (FIG. 2*f*).

Figure 2G:
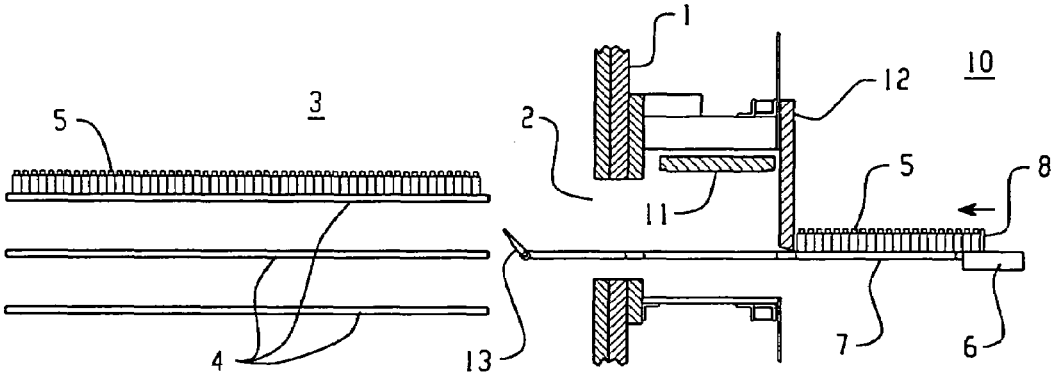
Figure 2H:
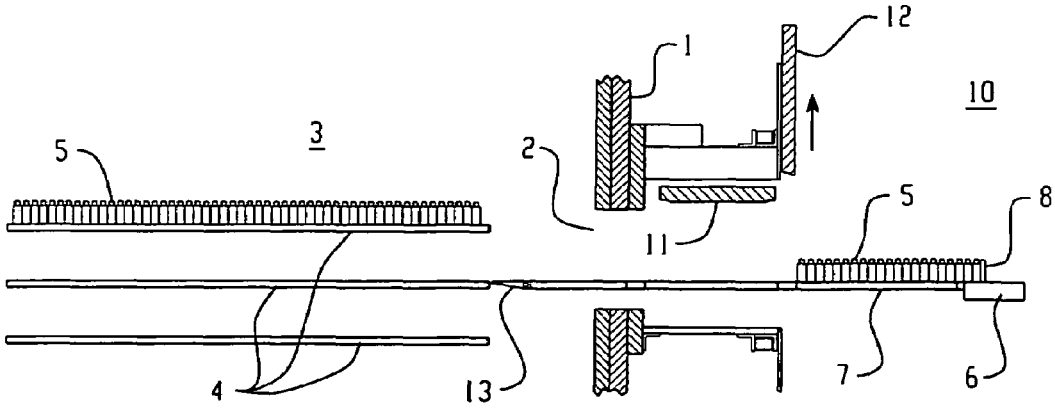

In order to prepare the loading of the next charging plate 4, the already filled charging plate 4 is moved upwards and the new charging plate 4 to be loaded is brought to the loading height (FIG. 2*g*). Already at that point in time formatting takes place of the containers 5 on the transfer table 7. FIG. 2*h* corresponds to FIG. 2*b*. It shows preparation of the first partial loading push for the second charging plate 4. Additional loading processes take place in the same manner as described with respect to FIGS. 2*c*-2*f* to load the second and subsequent charging plates.

Figure 3:
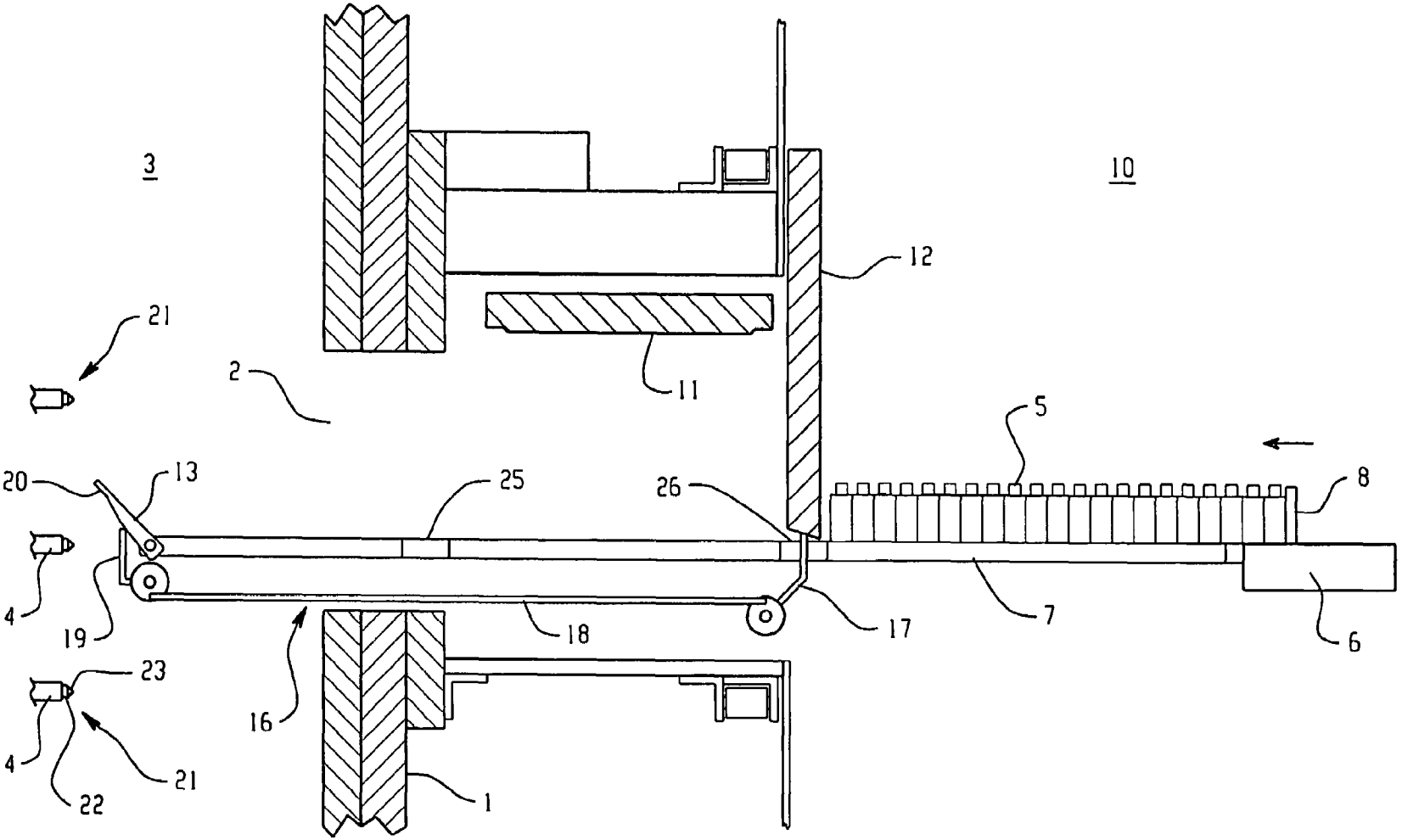

The described liftable edge sections 13 support the goal of achieving thermal uncoupling between inner space 3 of the freeze-drying chamber and outer space 10. FIG. 3 shows additional details. As described, the edge sections 13 assume during the loading pauses, i.e. during the loading pushes or partial pushes, their raised position. One possibility of activating the edge sections 13 comprises a lever system 16, which is operated by the sliding door 12. With the closing movement of the slider door 12, a first lever 17, which passes through the transfer table 7, is moved in downward direction. Said downward motion causes a longitudinal movement of a lever rod 16 extending in parallel to the transfer table 7 up to the edge section 13. Below the edge section 13, the movement of the lever rod 18 is translated into a rotational movement of another lever 19, which touches with its free end the underside of the edge section 13. The lever system 16 overall is designed in such manner that the downward movement of the sliding door 12 causes a lifting of the edge section 13. If the reverse movement takes place, the upward movement of the sliding door 12 releases the lever 17, due to the weight of edge section 13.

In FIG. 3, the lever system 16 is represented schematically and arranged below the transfer table 7. It is, however, appropriate to arrange the lever system 16, at least in part, in borings or recesses of the transfer table 7, so that it is capable, in its operating position, to close the area positioned below the transfer table 7 in that it rests upon the lower edge of said opening 2.

Figure 4:
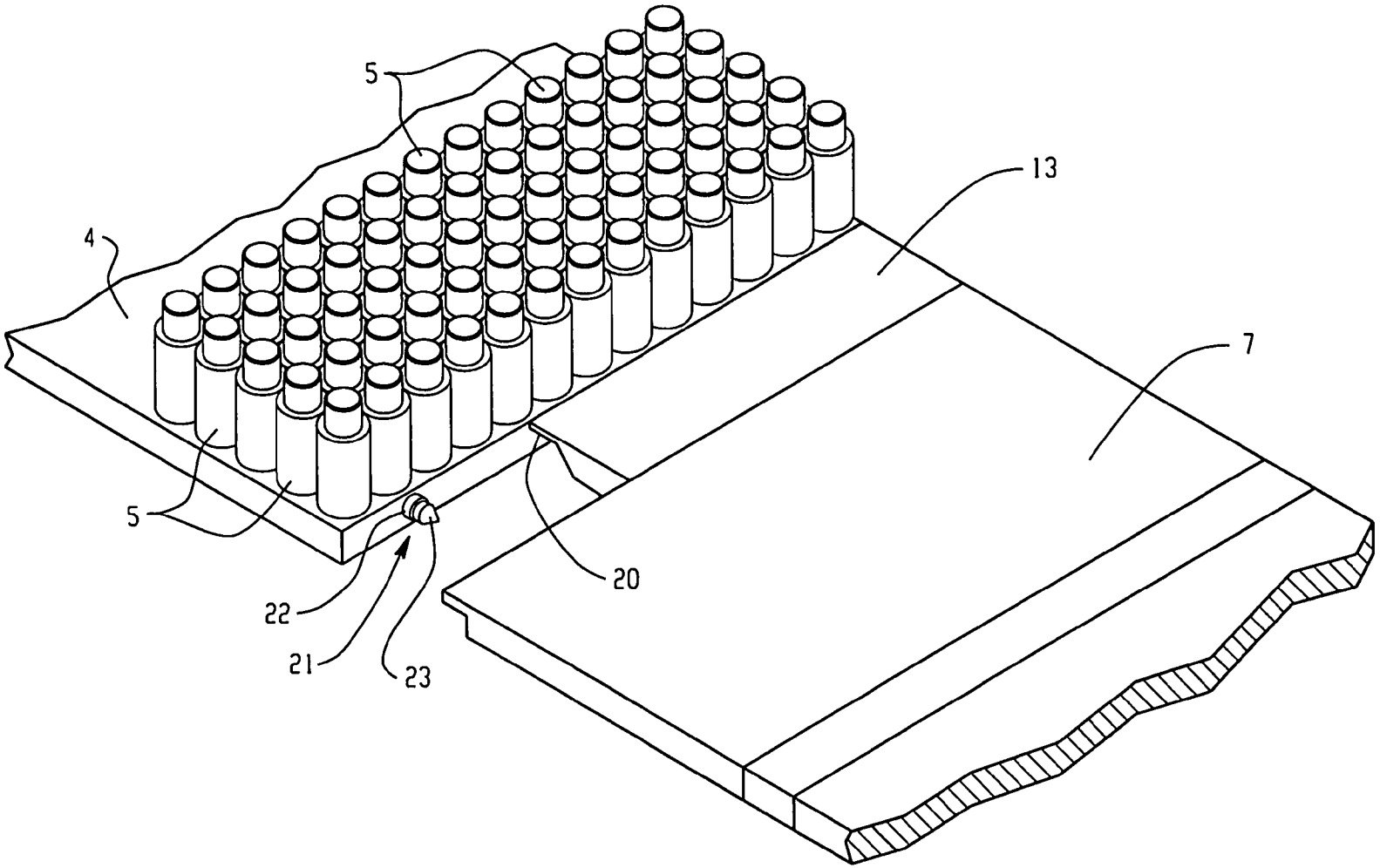
FIG. 4 shows, for example, embodiments of the edges of the transfer table and a charging area facing each other.

The edge sections 13 shall have only minimal surface contact with the charging areas 4 to be loaded, regardless of whether they can be raised or whether they maintain their operating position during loading pauses. In order to achieve this, the free edges of the edge sections 13 end in thin tongues 20, which lie in operating position of the edge sections 13 upon projections 21 (FIGS. 3 and 4). These are located on the front side of the charging plates 4 facing the transfer table 7. The projections 21 have a cylindrical section 22 (in proximity to the charging plate) and a conical section 23. If the edge sections 13, which have a slightly downward sloping position in their idle position, come close to the charging plates 4 while the transfer table 7 is approaching, then the tongues 20 first contact the conical section 23. They continue to slide on these sections and are raised until the transfer table 7 has attained its operating position. In said position, the tongues 20 are resting on the cylindrical section 22 in practically thin-line fashion, in other words with minimal surface contact. The dimensions of the described elements have been selected in such fashion that there is assurance of gap-free and continuous transition from the transfer table 7 to the charging plates 4.

One might do away with the described type of edge sections if one could achieve by other means optimum gap-free and continuous demarcation from transfer table 7 and charging plate 4 to be loaded. Likewise, a mechanical contact during loading pauses between transfer table 7 and charging plate 4 to be loaded could also be obtained in that the transfer table 7 is driven in reverse by only a very small distance. With respect to the represented embodiments, this is, however, not practical inasmuch as the reciprocal position of transfer table 7 and conveyor belt 6 are maintained between loading pushes.

Advantageously, a plurality of adjacently positioned edge sections 13 and projections 20 are present (FIG. 4) so that minor and unavoidable level differences of the relatively broad charging plates 4 can be equalized.

To the extent needed and required, all components of the described freeze-drying apparatus are traditionally made of stainless steel. According to an additional characteristic of the invention, this does not apply or at least does not fully apply with respect to transfer table 7. It is equipped with thermal transfer barriers which include a material that is a poor conductor of heat, for example plastic matter. Involved are strip-like sections 25, 26 which extend parallel to the front side of the transfer table 7. The first section 25 is located where the transfer table 7, in its operating position, rests on the lower edge of the loading aperture 2. The second section lies in the plane of the sliding door 12. The thermal barriers 25, 26 thereby not only prevent any flow of coldness from the region of the transfer table 7 close to the charging area to the area distant from the charging area, but also to the chamber wall 1 (section 25) as well as to the sliding door 12 (section 26).

The above described loading device is also employed for unloading the charging plates 4. As a rule, in doing so it is no longer required to provide for thermal uncoupling of the interior space 4 from the outer space 10.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A method for operating a freeze-driving apparatus which includes:

a chamber in which are located stacked charring plates;

the chamber having a loading aperture equipped with a closure through which aperture the charging plates located in the chamber are loaded with containers;

equipment positioned in front of the loading aperture for loading the charging plates with containers, the equipment including:

a conveyor belt, which serves to supply the containers, a transfer table movable between an operating position and an idle position, which transfer table in the operating position serves for bridging a gap between the conveyor belt and the charging plates, one or more edge sections being attached in an articulated fashion at a front side of the transfer table, a loading slider for pushing a plurality of the containers from the conveyor belt via the transfer table onto the charting plates; the method comprising:

retaining the transfer table substantially in the operating position during loading of the charging plates, limiting mechanical/thermal contact of the transfer table with the charging plates to time intervals during a loading push in which the loading slider pushes the containers onto the charging plates by:

lifting the one or more edge sections attached in articulated fashion at the free front side of the transfer table following a loading push; and lowering the one or more edge sections into contact with one of the charging plates prior to the next loading push.

2. The method according to claim 1, further including:

applying a plurality of the loading pushes to load each charging plate;

the step of lowering the one or more edge sections is performed before each of the loading pushes; and the step of lifting the one or more edge sections is performed after each of the loading pushes.

3. The method according to claim 2, further including:

opening a region above the loading aperture prior to each of the plurality of pushes; and closing at least the region above the loading aperture following each of the plurality of pushes.

4. The method according to claim 1, wherein the transfer table is smaller in area than the charging plate and further including:

transferring the containers directly from the conveyor belt to the transfer table without an intervening formatting table.

5. The method according to claim 1, further including:

closing a region of the loading aperture below the transfer table when the transfer table is in the operating position by resting the transfer table upon a lower edge of the loading aperture.

6. The method according to claim 1, wherein free ends of the edge sections end in thin tongues and sides of the charging plates facing the transfer table are equipped with projections upon which the tongues rest in an operating position of the transfer table to minimize thermal transfer.

7. The method according to claim 1, wherein the closure includes a sliding door and further including:

sliding the sliding door to close the loading aperture.

8. The method according to claim 7, wherein the freeze-drying apparatus includes a lever system which couples the movement of the sliding door and the edge sections, and further including:

moving the sliding door and lifting/lowering the side sections in coordination with each other.

9. The method according to claim 1, further including:

inhibiting thermal communication between the transfer table and the charging plates with at least one thermal barrier which extends parallel to a frong edge of the transfer table.

10. The method according to claim 9, further including:

aligning the thermal barrier with a sliding door that closes the loading aperture when the transfer table is in its operating position.

11. The method according to claim 9, further including:

aligning the thermal barrier with a lower edge of the loading aperture when the transfer table is in its operating position.

12. A method for operating a freeze-drying apparatus with:

a chamber in which are located superposed charging plates;

the chamber having a loading aperture equipped with a closure through which aperture the charging plates located in the chamber are loaded with containers;

equipment for loading the charging plates with containers being positioned in front of the loading aperture and comprising:

a conveyor belt, which serves to supply the containers, a transfer table movable between an operating position and an idle position, which in the operation position serves for bridging a gap between the conveyor belt and the charging plates, a loading slider for push-wise transferring a plurality of the containers from the conveyor belt via the transfer table to the charging plates;

the method including:

retaining the transfer table substantially in the operating position during loading of the charging plates, limiting mechanical/thermal contact of the transfer table with the charging plates to time intervals during which the loading slider is transferring the containers to the charging plates, and closing at least a region of the loading aperture located above the transfer table following a loading push.

13. The method according to claim 12, further including:

during a last phase of movement of the transfer table to the operating position, placing the transfer table on a lower edge of the loading aperture such that the region of the loading aperture lying below the transfer table is closed.

14. The method according to claim 13, further including:

limiting mechanical/thermal contact of the transfer table with the charging plates to time intervals in which a loading push takes place.

15. The method according to claim 14, further including:

raising one or several edge sections attached in an articulated fashion at a free front side of the transfer table following the loading push, and lowering the one or several edge sections prior to a next loading push.

16. The method according to claim 15, further including:

closing the upper portion of the loading aperture with a sliding door, closing movement of the sliding door causing the raising of the edge sections.

17. The method according to claim 12, wherein the loading of each charging plate includes:

a plurality of loading pushes, each loading push pushing a plurality of the containers onto one of the charging plates;

performing the step of opening at least the region of the loading aperture located above the transfer table preceding each of the loading pushes; and performing the step of closing at least the region of the loading aperture located above the transfer table following each of the loading pushes.

18. The method according to claim 12, further including:

closing the upper region of the loading aperture with a sliding door; and lifting of the edge sections in response to closing the upper region of the loading aperture.

19. The method according to claim 12, further including:

positioning the transfer table on a lower edge of the loading aperture such that a region of the loading aperture located below the transfer table is closed.

20. A method for operating a freeze-drying apparatus including:

a chamber in which a stack of charging plates are located;

the chamber having a loading aperture equipped with closing means, through which aperture the charging plates located in the chamber are loaded with containers;

equipment positioned in front of the loading aperture for loading the charging plates with containers, the equipment including:

a conveyor belt which supplies the containers to be loaded, and a transfer table movable between an operating position and an idle position, the transfer table bridging a space between the conveyor belt and one of the charging plates, a loading slider for push-wise transferring a plurality of containers from the conveyor belt via the transfer table onto one of the charging plates with a loading push;

the method comprising:

while retaining the transfer table in the operating position, loading of the containers onto the charging plates with a plurality of loading pushes; and closing at least a region of the loading aperture positioned above the transfer table between the loading pushes.

21. The method according to claim 20, further including:

limiting mechanical/thermal contact of the transfer table with the charging plates being loaded only to a time interval during which the loading slider is transferring containers onto one of the charging plates being loaded.

22. The method according to claim 20, further including:

lowering one or more transfer table edge sections into contact with a one of the charging plates being loaded prior to each of the plurality of loading pushes; and lifting the one or more edge sections following each of the plurality of loading pushes.

* * * * *